US007777687B2

(12) United States Patent
Shibata et al.

(10) Patent No.: US 7,777,687 B2
(45) Date of Patent: Aug. 17, 2010

(54) ELECTRONIC DEVICE CONTAINING CASE, ELECTROMAGNETIC SHIELD BODY, AND ELECTRONIC DEVICE CONTAINING STRUCTURE

(75) Inventors: Osamu Shibata, Hyogo (JP); Yoshiyuki Saito, Osaka (JP)

(73) Assignee: Panasonic Corporation, Osaka (JP)

( * ) Notice: Subject to any disclaimer, the term of this patent is extended or adjusted under 35 U.S.C. 154(b) by 396 days.

(21) Appl. No.: 12/064,890

(22) PCT Filed: Sep. 21, 2006

(86) PCT No.: PCT/JP2006/318726

§ 371 (c)(1),
(2), (4) Date: Feb. 26, 2008

(87) PCT Pub. No.: WO2007/034869

PCT Pub. Date: Mar. 29, 2007

(65) Prior Publication Data

US 2009/0146901 A1 Jun. 11, 2009

(30) Foreign Application Priority Data

Sep. 26, 2005 (JP) ..... 2005-277736

(51) Int. Cl.
*H01Q 1/52* (2006.01)
*H01Q 1/24* (2006.01)

(52) U.S. Cl. ..... 343/841; 343/702

(58) Field of Classification Search ..... None
See application file for complete search history.

(56) References Cited

U.S. PATENT DOCUMENTS

| | | | | |
|---|---|---|---|---|
| 5,367,309 | A * | 11/1994 | Tashjian | 343/702 |
| 6,075,977 | A * | 6/2000 | Bayrami | 455/575.5 |
| 2005/0001773 | A1 * | 1/2005 | Morningstar et al. | 343/702 |
| 2005/0104782 | A1 * | 5/2005 | Peled et al. | 343/702 |
| 2005/0156806 | A1 | 7/2005 | Ohta et al. | |

FOREIGN PATENT DOCUMENTS

| | | |
|---|---|---|
| JP | 4-294599 | 10/1992 |
| JP | 5-26786 | 2/1993 |
| JP | 7-193877 | 7/1995 |
| JP | 11-17431 | 1/1999 |
| JP | 11-284426 | 10/1999 |
| JP | 2001-94343 | 4/2001 |
| JP | 3184275 | 4/2001 |
| JP | 2003-78941 | 3/2003 |
| JP | 2003-283365 | 10/2003 |
| JP | 2004-96607 | 3/2004 |
| JP | 2004-145250 | 5/2004 |
| JP | 2004-252562 | 9/2004 |
| JP | 2004-270143 | 9/2004 |
| JP | 2005-45625 | 2/2005 |
| JP | 2005-165519 | 6/2005 |

* cited by examiner

*Primary Examiner*—Trinh V Dinh
(74) *Attorney, Agent, or Firm*—McDermott Will & Emery LLP

(57) ABSTRACT

A main object of the present invention is to reliably perform radio communication in an electronic device containing case without spoiling an aesthetic aspect thereof. In order to achieve the object, an electromagnetic shield body is provided on a wall surface of the case for containing an electronic device capable of the radio communication.

10 Claims, 12 Drawing Sheets

ELECTRONIC DEVICE CONTAINING CASE, ELECTROMAGNETIC SHIELD BODY, AND ELECTRONIC DEVICE CONTAINING STRUCTURE

RELATED APPLICATIONS

This application is the U.S. National Phase under 35 U.S.C. §371 of International Application No. PCT/JP2006/318726, filed on Sep. 21, 2006, which in turn claims the benefit of Japanese Application No. 2005-277736, filed on Sep. 26, 2005, the disclosures of which Applications are incorporated by reference herein.

FIELD OF THE INVENTION

The present invention relates to an electronic device containing case for containing a plurality of electronic devices provided with a radio communication function, an electromagnetic shield body, and an electronic device containing structure.

BACKGROUND OF THE INVENTION

In recent years, such AV devices connected to a display as an HDD recorder, a DVD player, a set-top box and an AV amplifier are increasingly made commercially available, as a result of which the connection for an image or audio between different devices are increasingly complicated. In order to solve the foregoing problem, electronic devices provided with a radio communication function which eliminate the need for any physical connection by users are increasing. However, the radio communication has unfavorably led to the failure of the communication resulting from the interference of electromagnetic waves as the radio communication is more often performed. In order to unfailingly perform the radio communication in an AV rack, there is a conventional technology for improving an accuracy in the communication of a remote control signal in the AV rack as recited in the Patent Document 1.

In the conventional technology, an optical function layer characterized as follows is provided at a front door:

- light in a visible range is transmitted therethrough both outside and inside;
- a signal in an infrared range from inside is reflected thereon; and
- a signal in the infrared range from outside is absorbed therein.

Patent Document 1: H07-193877 of the Japanese Patent Applications Laid-Open

Problem to be Solved by the Invention

In the radio transmission in the GHz band which is often adopted in a close-range radio communication in recent years, a non-transparent layer that does not transmit visible rays needs to be employed as the optical function layer so that a signal is reflected thereon or absorbed therein. However, when such an optical function layer is provided in the front door, an aesthetic aspect of the AV rack is thereby adversely affected.

The present invention was made in order to solve the foregoing conventional problem, and a main object thereof is to reliably perform the radio communication without spoiling the aesthetic aspect of the AV rack and to make it unlikely to cause any interference with other devices by making effective changes to the layout.

Means for Solving the Problem

In order to achieve the foregoing object, in the present invention, an electromagnetic shield body is provided on a wall surface of a case where an electronic device capable of the radio communication is contained. Accordingly, the radio communication can be unfailingly performed without impairing the aesthetic aspect of the electronic device containing case.

The electronic device preferably comprises a radio communication antenna, and the electromagnetic shield body is preferably provided on the wall surface of the case which faces the radio communication antenna. Accordingly, the radio communication can be more reliably performed. In the foregoing constitution, the electromagnetic shield body is preferably provided on the rear surface of the case in terms of a structure of the case and an electronic device containing structure.

The electromagnetic shield body preferably has a curved-surface shape where an inner side thereof with respect to the case is concaved. Accordingly, the transmission and reception in the radio transmission and reception can be more accurate, and the radio communication can be thereby more reliable.

The electromagnetic shield body is preferably a metallic net having a mesh shape. Accordingly, the radio communication can be performed while a heat-releasing performance in the case can be increased.

An antenna pattern for the radio communication which can be connected to the electronic device is preferably provided in the electromagnetic shieldbody. Accordingly, the antenna pattern can be connected to the electronic device and used as the radio communication antenna of the electronic device, wherein the radio communication can be performed while the power of a communication radio wave is further controlled. In the case where the antenna pattern is utilized as the antenna of the electronic device provided on the electronic device containing case, in particular, the radio communication between the device in the electronic device containing case and the electronic device outside can be more reliably performed.

The electromagnetic shield body is preferably a metallic net having a mesh shape, wherein the electromagnetic shield body comprises a narrowed-down portion formed when the electromagnetic shield body is folded and narrowed down into an arbitrary shape, and the antenna pattern is provided in the narrowed-down portion. Accordingly, the radio communication can be more reliably performed with the inside and outside of the electronic device containing case, and any noise coming from outside can be prevented from invading the antenna pattern. The narrowed-down portion may be preferably on a surface of the electromagnetic shield body located on an outer side of the case or on an inner side of the case depending on required directions where the transmission and reception are performed.

A wiring length of the antenna pattern is preferably ¼ of a communication radio wavelength in the radio communication. Accordingly, the communication radio wavelength can be surely grasped.

At least one of surfaces of the case on which the electromagnetic shield body is not provided is electromagnetically shielded. Accordingly, the radio communication can be performed in a state where the electromagnetic wave interference is further controlled.

The electromagnetic shield body preferably has a multilayered structure provided with an electromagnetic reflector and an electromagnetic absorber, wherein the electromagnetic shield body is provided on the wall surface of the case so that the electromagnetic reflector is on the inner side of the case and the electromagnetic absorber is on the outer side of the case. Accordingly, the electromagnetic wave coming from the inside of the case is surely reflected toward the inside of the case, while the electromagnetic wave coming from the outside of the case is surely absorbed. As a result, the radio communication with a high accuracy can be performed while the electromagnetic wave interference is controlled.

In the case where an electronic device provided with an antenna for radio communication having directivity in transmission/reception sensibility is contained in the electronic device containing case, the electronic device is preferably contained in the case so that a direction where the transmission/reception sensibility of the antenna is maximized. Accordingly, the radio communication can be performed while the power of the communication radio wave is further controlled.

Effect of the Invention

According to the present invention, the radio communication between the electronic devices contained in the electronic device containing case or provided on the case can be supported without any adverse influence on the aesthetic aspect of the electronic device containing case, and the interference of the noise coming from outside can be prevented.

According to the present invention, the radio communication can be more reliably performed. Further, the radio communication can be performed while the heat-releasing performance in the case is increased. Further, the radio communication can be more accurately performed while the power of the communication radio wave is further controlled. Further, the radio communication can be more reliably performed with the outside or the inside of the electronic device containing case, and the communication radio wave of the radio communication in any arbitrary band can be more reliably grasped. Further, the radio communication can be performed in the state where the electromagnetic wave interference is further controlled.

DESCRIPTION OF REFERENCE SYMBOLS

Figure 1:
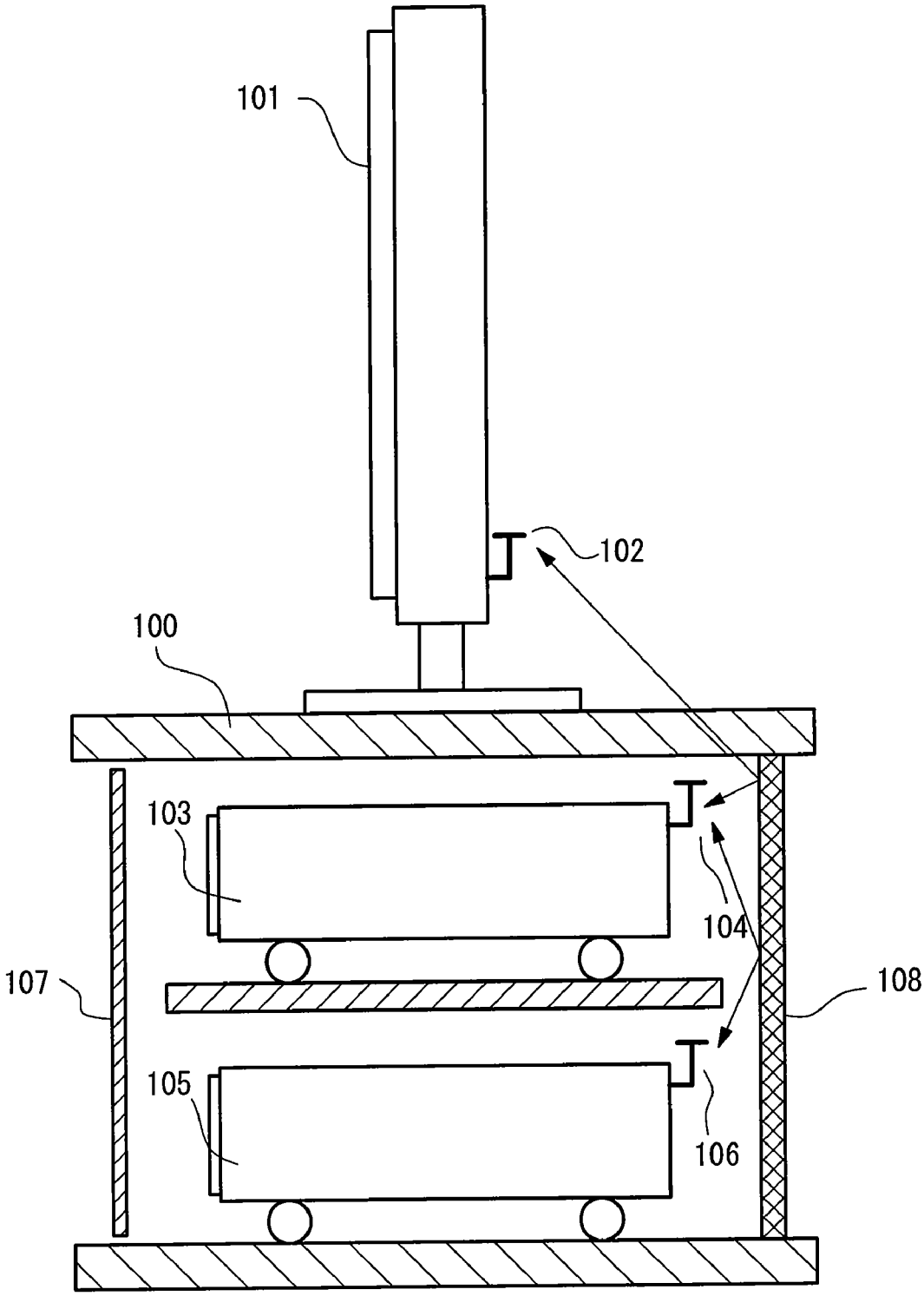
FIG. 1 shows an electronic device containing case and a structure where an electronic device is contained in the case according to a preferred embodiment 1 of the present invention.

100, 200, 300, 400, 500, 700 . . . electronic device containing case
101, 103, 105, 301, 303, 305, 401 . . . electronic device
102, 104, 106, 302, 304, 306, 402, 502, 602 . . . radio communication antenna
107, 707 . . . front door
108, 208, 408, 508, 608 . . . electromagnetic shield body

PREFERRED EMBODIMENTS OF THE PRESENT INVENTION

Hereinafter, preferred embodiments of the present invention are described referring to the drawings.

Preferred Embodiment 1

FIG. 1 shows an electronic device containing case 100 and a structure where an electronic device is contained in the electronic device containing case 100 according to a preferred embodiment 1 of the present invention.

The electronic device containing case (hereinafter, simply referred to as case) 100 is formed from a wood member or a resin member which does not include any function of blocking or reflecting an electromagnetic wave. The case 100 comprises a front door 107 on the front surface thereof and an electromagnetic shield body 108 which blocks or reflects the electromagnetic wave on the rear surface thereof. The electromagnetic shield body 108 is attached so as to cover the rear surface of the case. Electronic devices 101, 103 and 105 are contained in the case 100 or provided on the case 100. The electronic devices 101, 103 and 105 respectively comprise antennas 102, 104 and 106, and have a function of performing of an inter-device radio communication via the antennas 102, 104 and 106.

A transparent glass door is used as the front door 107 in view of its aesthetic aspect. The electronic device 101 provided on the case 100 is, in general, a synchronizing device, examples of which are PDP, LCD, CRT and the like. The electronic devices 103 and 105 provided in the case 100 are, in general, source devices, examples of which are a DVD player, a DVD recorder, a set-top box, an AV amplifier and the like.

The electronic devices 101, 103 and 105 wirelessly communicate with one another via the electromagnetic waves transmitted from the antennas 102, 104 and 106. The radio communication is performed directly among the devices, or via the electromagnetic wave reflected by the electromagnetic shield body 108 formed on the rear surface of the case 100. The electronic devices 101, 103 and 105 are arranged in or on the case 100 so that the antennas 102, 104 and 106 are provided on the opposite side of the front door 107, in other words, on the side where the electromagnetic shield body 108 is provided. Accordingly, the inter-device radio communication can be more accurate. Further, each of the electronic devices 101, 103 and 105 is generally covered with a metallic cabinet. When an electromagnetic wave is transmitted from outside from a forward direction of the case 100 in the state where the antennas 102, 104 and 106 are provided on the opposite side (rear-surface side) of the front door 107, therefore, it is difficult for the electromagnetic wave from outside to reach the antennal 102, 104 and 106. When an electromagnetic wave from outside is transmitted from the rear surface of the case, the electromagnetic wave from outside is blocked by the electromagnetic shield body 108 provided on the rear surface of the case and thereby fails to reach the antennas 102, 104 and 106. With the reason thus described, the signal interception is hardly generated in the radio communication via the antennal 102, 104 and 106.

In the case where a main object is electromagnetic reflection (eliminate the invasion of the electromagnetic wave from outside and assist in the inter-device radio communication), the electromagnetic shield body 108 is suitably formed from metal, such as aluminum, which reflects the electromagnetic wave. In the case where the main object is the electromagnetic absorption (eliminate the invasion of the electromagnetic wave from outside and eliminate the dispersion of the internal electromagnetic wave), the electromagnetic shield body 108 is suitably formed from a magnetic body, such as ferrite, which absorbs or thermally converts the electromagnetic wave.

As described, according to the present invention, the radio communication among the electronic devices 101, 103 and 105 contained in the case 100 or provided on the case 100 can be more accurately performed without any damage to the aesthetic aspect of the case 100, and the noise from outside can be eliminated.

Figure 2:
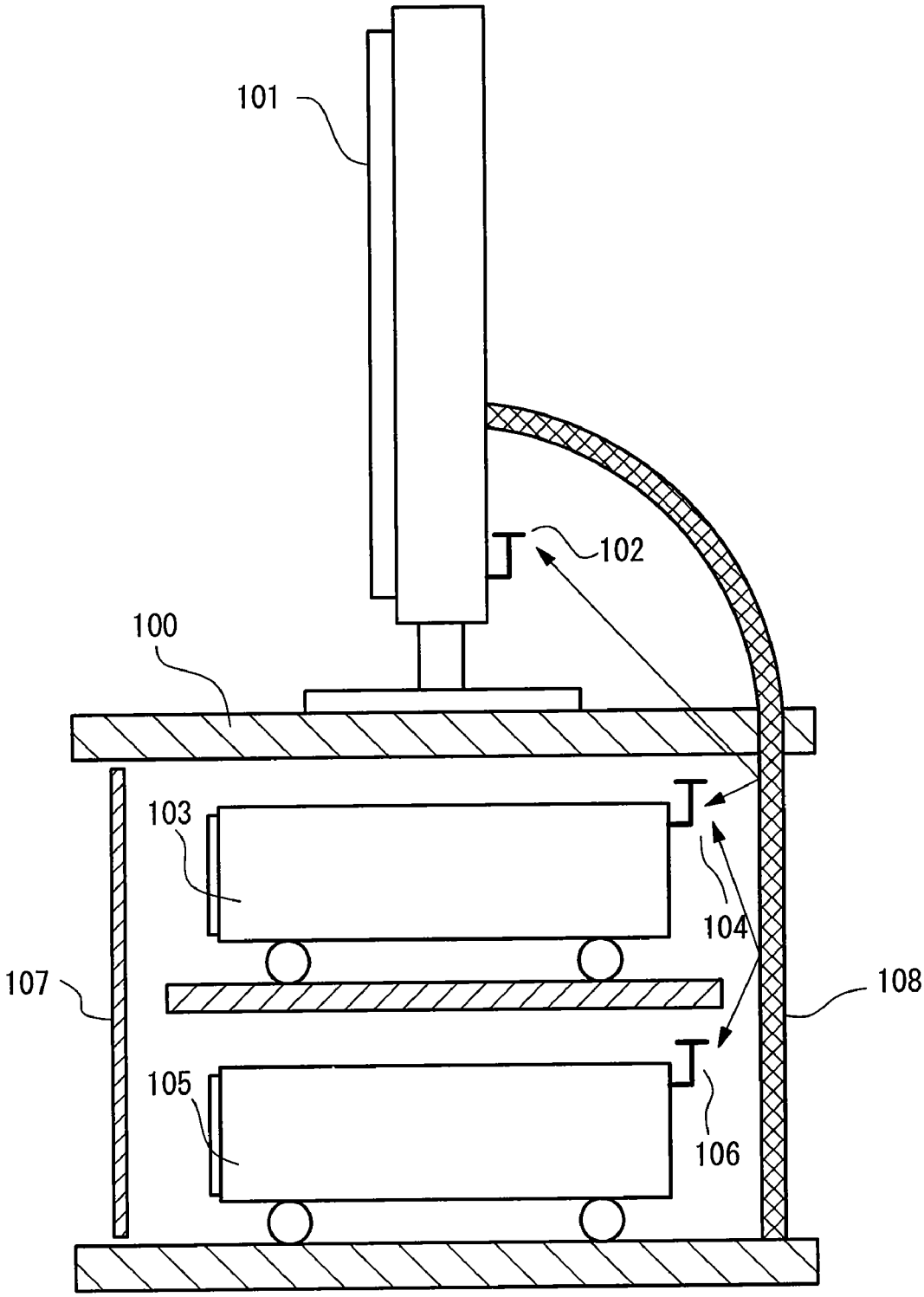
FIG. 2 shows an electronic device containing case and a structure where an electronic device is contained in the case according to a modified embodiment of the preferred embodiment 1.

In the constitution shown in FIG. 1, the electromagnetic shield body 108 has a dimension in height which reaches an upper surface of the case 100; however, the dimension of the electromagnetic shield body 108 in height is not limited thereto. As shown in FIG. 2, the electromagnetic shield body 108 may be extended beyond the upper surface of the case and further upward (more specifically, up to a position where the antenna 102 of the electronic device 101 is covered).

Further, the electromagnetic shield body 108 may be formed from a metallic net having a mesh shape (for example, copper-wire mesh which is insulatingly coated). Accordingly, the heat-releasing performance inside the case 100 is increased, and also, the accuracy (efficiency) in the radio communication can be increased.

In the present preferred embodiment, the number of the antennal 102, 104 and 106 provided in the respective devices 101, 103 and 105 is one each. However, a plurality of respective antennas may be provided in each of the devices 101, 103 and 105.

The radio communication between the electronic devices 101, 103 and 105 (hereinafter, referred to as internal devices) contained in the electronic device containing case 100 or provided thereon and any other electronic device (hereinafter, referred to as external device) is performed as follows. One of the internal devices (for example, electronic device 101 such as TV) is arbitrarily selected as a representative of the devices, and the arbitrarily selected device performs the radio communication with the external device. Then, the arbitrary internal device wirelessly communicates with the other internal devices. Thus, the other devices wirelessly communicate with the external device via the arbitrary internal device. As an alternative constitution, an internal device can communicate with an external device via a wired interface (for example, power supply wire or the like) connected to the internal devices.

Preferred Embodiment 2

Figure 3:
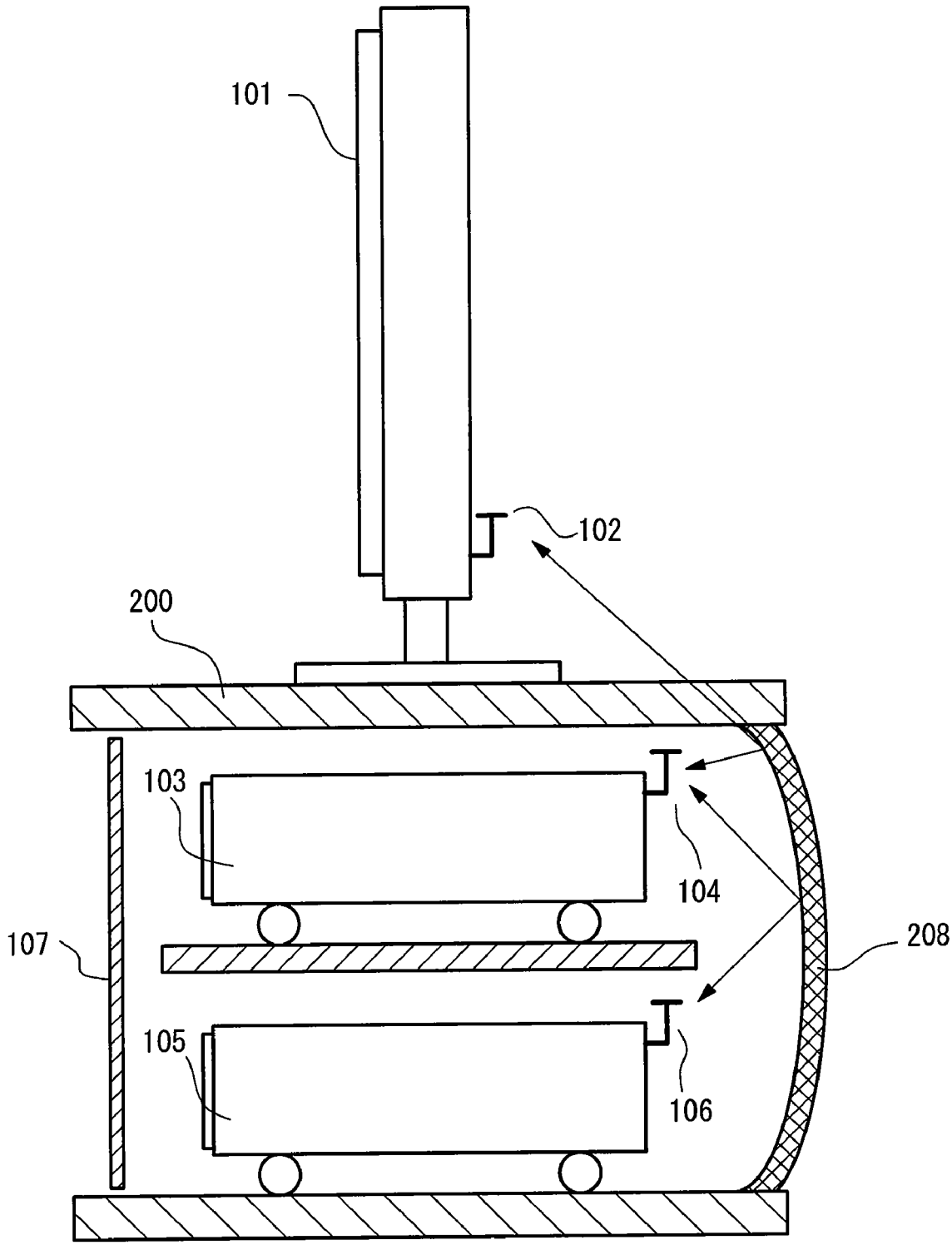
FIG. 3 shows an electronic device containing case and a structure where an electronic device is contained in the case according to a preferred embodiment 2 of the present invention.

FIG. 3 shows an electronic device containing case 200 and a structure where an electronic device is contained in the electronic device containing case 200 according to a preferred embodiment 2 of the present invention. In FIG. 3, the same components as those shown in FIG. 1 are provided with the same reference symbols, and the description of the components is omitted.

In the present preferred embodiment, an electromagnetic shield body 208 formed on the rear surface has a curved-surface shape in which an inner side thereof with respect to the case is concaved. Accordingly, the electromagnetic wave is efficiently concentrated inside the case 200 by an concave lens effect of the electromagnetic shield body 208, and the radio communication can be more reliably performed.

Preferred Embodiment 3

Figure 4:
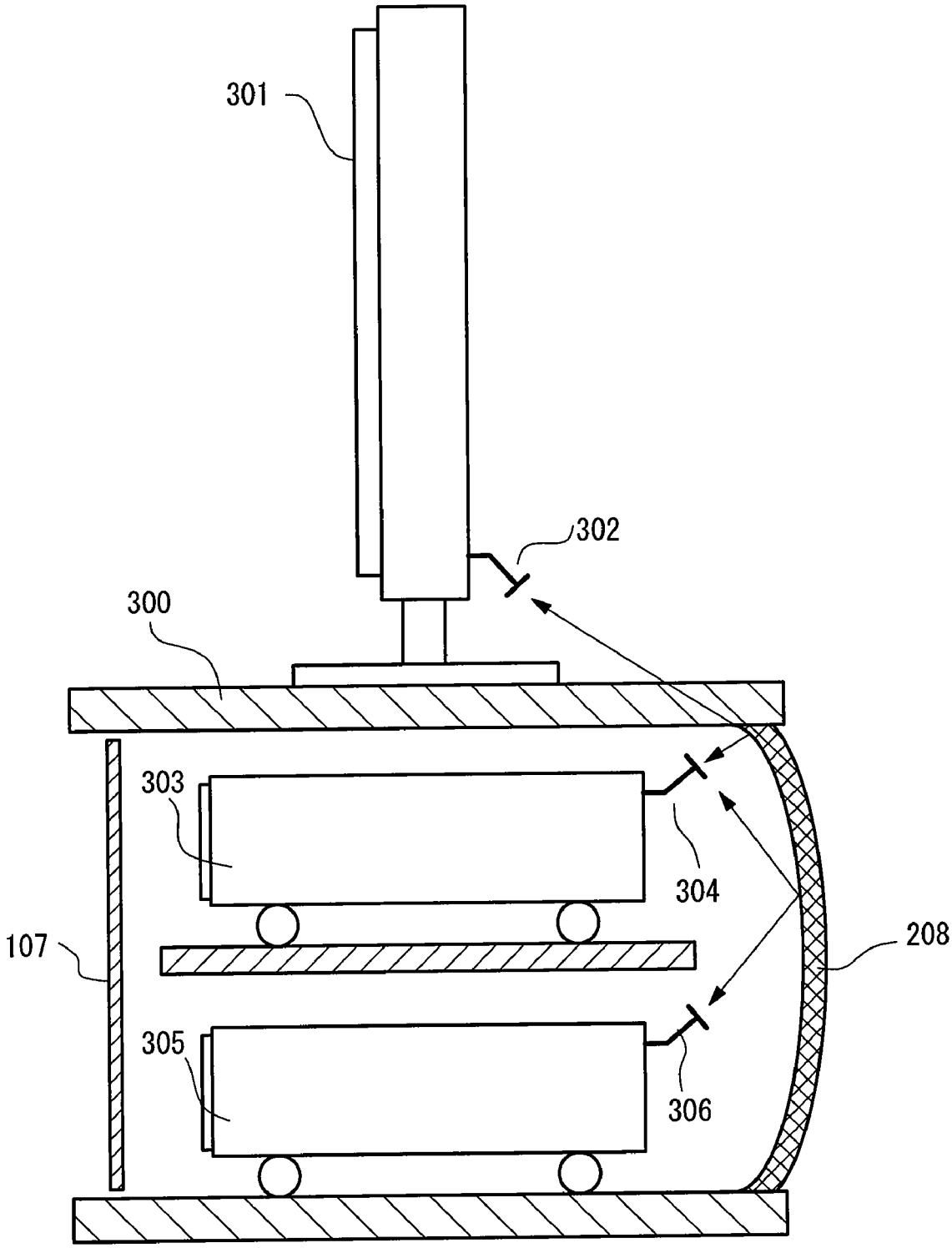
FIG. 4 shows an electronic device containing case and a structure where an electronic device is contained in the case according to a preferred embodiment 3 of the present invention.

FIG. 4 shows an electronic device containing case 300 and a structure where an electronic device is contained in the electronic device containing case 300 according to a preferred embodiment 3 of the present invention. In FIG. 4, the same components as those shown in FIGS. 1 and 3 are provided with the same reference symbols, and the description of the components is omitted.

In the present preferred embodiment, antennas 302, 304 and 306 of respective electronic devices 301, 303 and 305 each has a directivity in the reception sensibility, and the antennas 302, 304 and 306 are directed in directions where the reception sensibility is maximized in the respective directivities. More specifically, the antennas 302, 304 and 306 are provided so that the direction where the reception sensibility of each antenna is maximized is directed toward the electromagnetic shield body 208 provided on the rear surface of the case. As a result, the radio communication can be performed while the power of the electromagnetic wave is controlled.

In the present preferred embodiment, the directions of the antennas 302, 304 and 304 are fixed; however, may be variable. In order to change the directions, a machine mechanism device manually operable may be adopted, or an electric mechanism device operable by an electrically-driven motor may be adopted. Accordingly, the antennas 302, 304 and 304 can be directed in the directions where the transmission/reception sensibility is maximized, after the intensity of the radio communication via the electromagnetic shield body 208 is measured (for example, the power of the electromagnetic wave, error rate and the like are measured).

In the present preferred embodiment, the number of the respective antennas provided in the respective devices is one each. However, there may be a plurality of antennas, in which case it is unnecessary to set the directivities of the antennas in each device at the same direction, and the different directions may be set.

Preferred Embodiment 4

Figure 5:
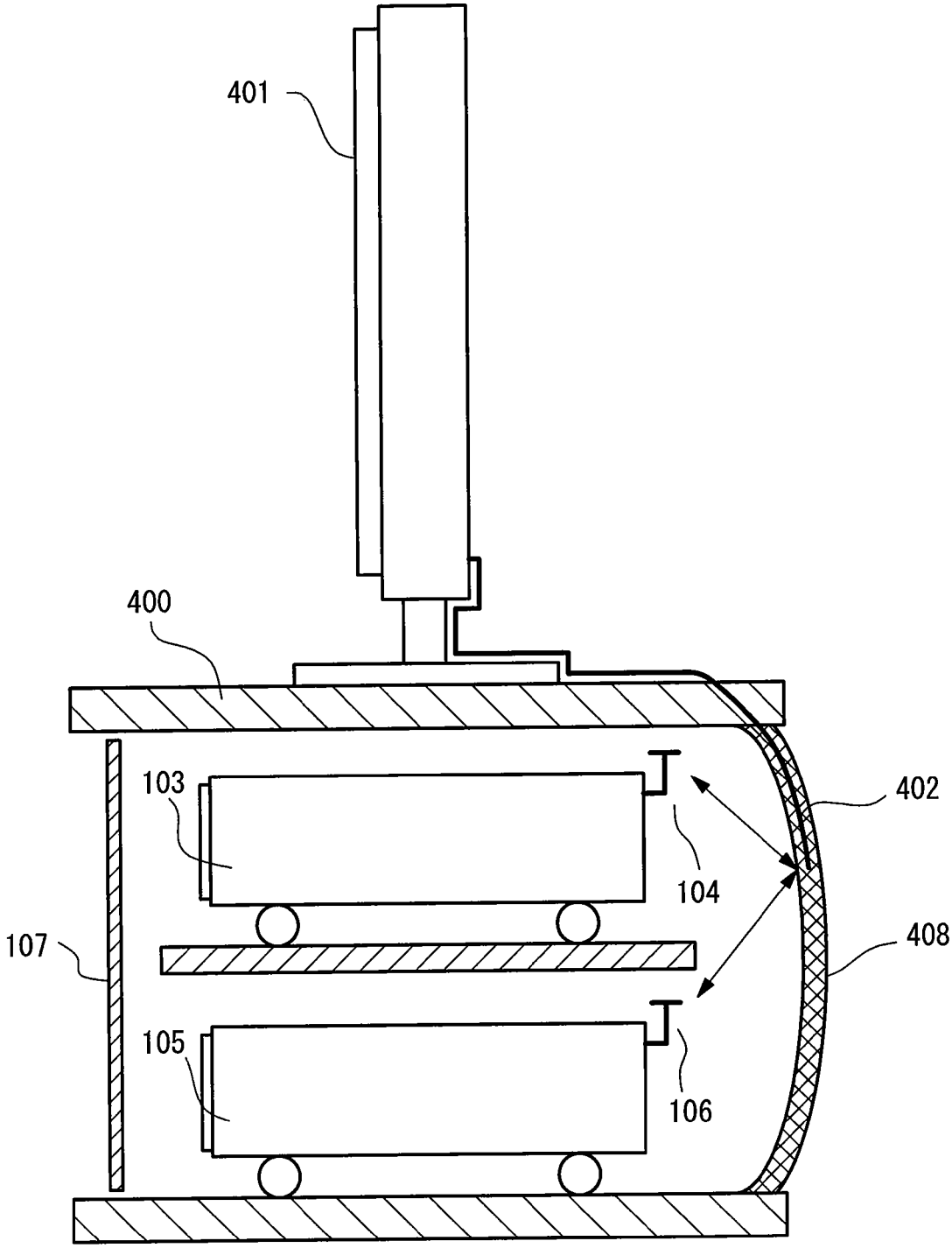
FIG. 5 shows an electronic device containing case and a structure where an electronic device is contained in the case according to a preferred embodiment 4 of the present invention.

FIG. 5 shows an electronic device containing case 400 and a structure where an electronic device is contained in the electronic device containing case 400 according to a preferred embodiment 4 of the present invention. In FIG. 5, the same components as those shown in FIGS. 1 and 3 are provided with the same reference symbols, and the description of the components is omitted.

In the present preferred embodiment, an antenna pattern 402 is formed in an electromagnetic shield body 408 formed on the rear surface of the case. The antenna pattern 402 is connected to one of electronic devices 401, 103, 105 capable of the radio communication. The electronic device to which the antenna pattern 402 is connected performs the radio communication via the antenna pattern 402. The electronic device to be selected is preferably the electronic device 401 provided on the upper surface of the case, which has difficulty relatively in communicating with the other electronic devices provided in the case. However, it is needless to say that either of the other devices can also be selected.

Accordingly, the radio communication can be accurately performed while the power of the electromagnetic wave is further controlled. In the case where the antenna pattern 402 is used as the antenna of the electronic device 401 provided on the upper surface of the case, in particular, the electronic device 401 can more reliably perform the radio communication with the electronic devices 103 and 105 provided in the case.

The present embodiment illustrates the case where the number of the antenna formed in the electromagnetic shield body is only one, but the number of the antenna may be two or more.

Further, a certain amount of the shield metal in the electromagnetic shield body 408 in the periphery of the antenna pattern 402 may be removed so that the electromagnetic wave can be emitted from the antenna pattern 402.

Preferred Embodiment 5

Figure 6:
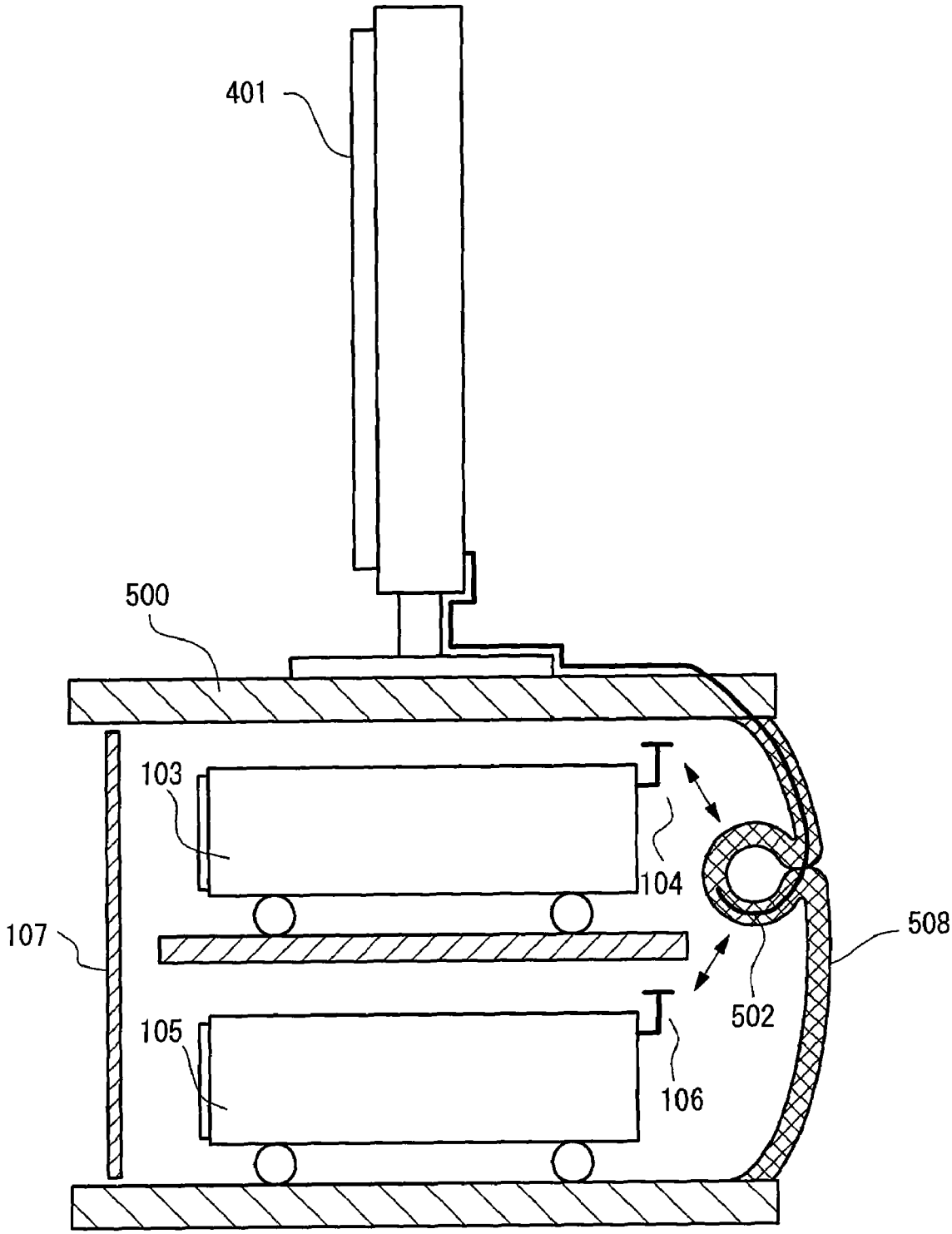
FIG. 6 shows an electronic device containing case and a structure where an electronic device is contained in the case according to a preferred embodiment 5 of the present invention.
Figure 7:
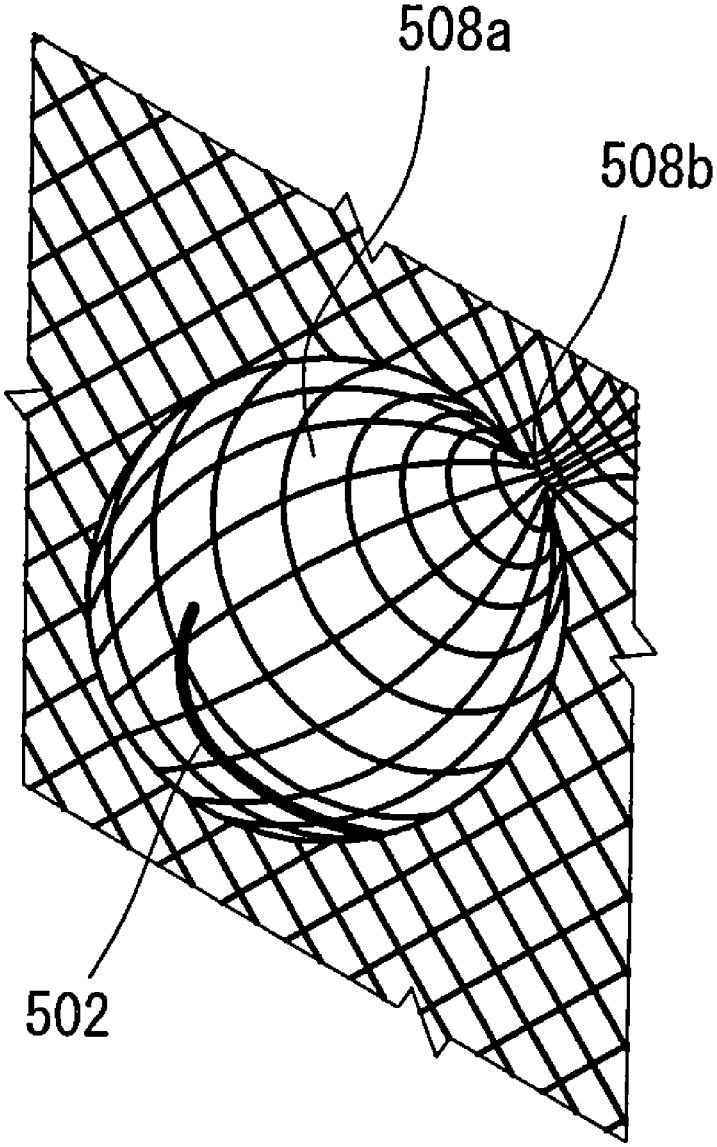
FIG. 7 is an enlarged perspective view of a main part of the electronic device containing case according to the preferred embodiment 5.
Figure 8:
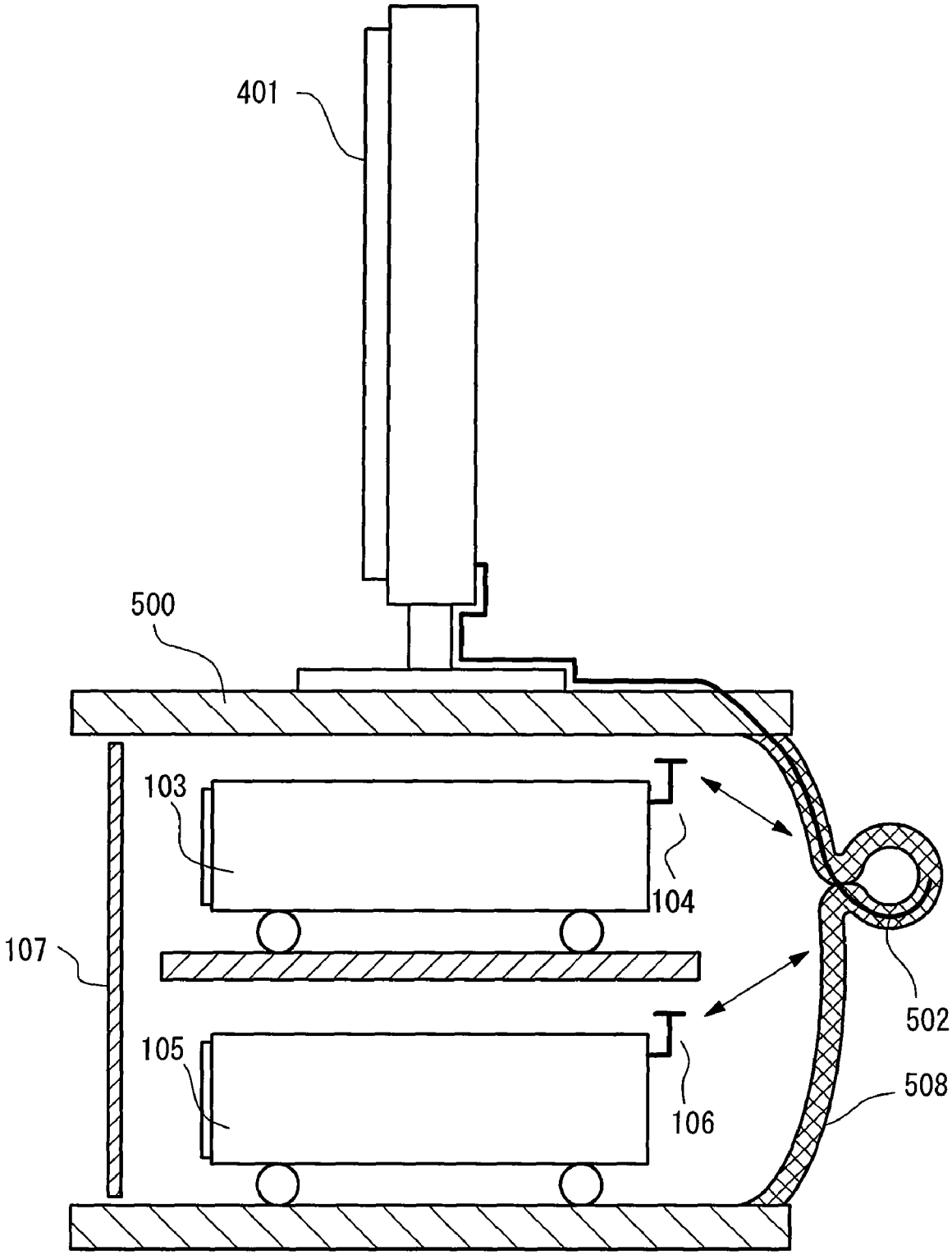
FIG. 8 shows an electronic device containing case and a structure where an electronic device is contained in the case according to a modified embodiment of the preferred embodiment 5.

FIG. 6 shows an electronic device containing case 500 and a structure where an electronic device is contained in the electronic device containing case 500 according to a preferred embodiment 5 of the present invention. FIG. 7 is an enlarge view of a main part of FIG. 6, and FIG. 8 shows a modified embodiment of the preferred embodiment 5. The same components in these drawings as those shown in FIGS. 1 and 2 are provided with the same reference symbols, and the description of the components is omitted.

The present preferred embodiment is basically constituted in a manner similar to the preferred embodiment 4. An antenna pattern 502 is provided in an electromagnetic shield body 508 provided on the rear surface of the case; however, a structure where the antenna pattern 502 is set is different to that of the preferred embodiment 4. In the present preferred embodiment, the electromagnetic shield body 508 comprises a narrowed-down portion 508*a*. The narrowed-down portion 508*a* is provided on the electromagnetic shield 508 located on the inner side of the case. The narrowed-down portion 508*a* is obtained when the electromagnetic shield body 508 formed from metallic mesh is folded and narrowed down into a spherical shape (or a polyhedral shape). A constricted portion 508*b* is provided between the narrowed-down portion 508*b* and the electromagnetic shield body 508. The narrowed-down portion 508*a* formed when the electromagnetic shield body 508 is narrowed down into a spherical shape or the like has a structure in which the electromagnetic shield body is closed. As a result, the electromagnetic shield body 508 can maintain its shielding performance since a continued (closed) planar shape is retained irrespective of the provision of the narrowed-down portion 508*a*.

The antenna pattern 502 is provided in a region of the electromagnetic shield body 508 where the narrowed-down portion 508*a* is formed. The antenna pattern 502 is connected to one of the electronic devices 401, 103 and 105 capable of the radio communication. The electronic device to which the antenna pattern 502 is connected performs the radio communication via the antenna pattern 502. The electronic to be selected is preferably the electronic device 401 provided on the upper surface of the case, which has difficulty relatively in communicating with the other electronic devices provided in the case. However, it is needless to say that either of the other devices can also be selected.

Accordingly, the radio communication can be accurately performed while the power of the electromagnetic wave is further controlled. In the case where the antenna pattern 502 is used as the antenna of the electronic device 401 provided on the upper surface of the case, the electronic device 401 can more reliably perform the radio communication with the electronic devices 103 and 105 provided in the case. Further, the electromagnetic wave is transmitted to and received from the antenna pattern 502 only within inside the case because the antenna pattern 502 is provided in the narrowed-down portion 508*a*. Therefore, the radio communication can be more reliably performed between the antenna pattern 502 and the antennas 104 and 106 in the case. Further, the planar structure (shielding performance) of the electromagnetic shield body 508 is maintained because the narrowed-down portion 508*a* is provided, which prevents the invasion of noise from outside into the antenna pattern 502.

In the present preferred embodiment, the number of the antenna pattern 502 is one; however, may be at least two. A certain amount of the shield metal of the electromagnetic shield body 508 (narrowed-down portion 508*a*) in the periphery of the antenna pattern 502 may be removed so that the electromagnetic wave can be emitted from the antenna pattern 502.

In the present preferred embodiment, the narrowed-down portion 508*a* (antenna pattern 502) is provided on the electromagnetic shield body 508 located on the inner side of the case. However, the narrowed-down portion 508*a* (antenna pattern 502) may be provided on the electromagnetic shield body 508 located on the outer side of the case as shown in FIG. 8 when the radio communication is performed externally. Thus constituted, the radio communication can be more reliably performed with respect to the electronic device outside of the electronic device containing case, and the invasion of the noise from outside into the case can be prevented. In the case where the antenna pattern 502 for the external communication is formed in large dimensions, the electromagnetic wave can be more effectively transmitted and received than in the case where the antenna is directly provided in the electronic device.

In the foregoing description, the number of the narrowed-down portion 508*a* and the antenna pattern 502 provided in the electromagnetic shield body 508 is one each; however, at least two narrowed-down portions 508*a* may be provided, and the antenna pattern 502 may be provided in each of the narrowed-down portions 508*a*, or a plurality of antenna patterns 502 may be provided in one or at least two narrowed-down portions 508*a*.

Preferred Embodiment 6

Figure 9:
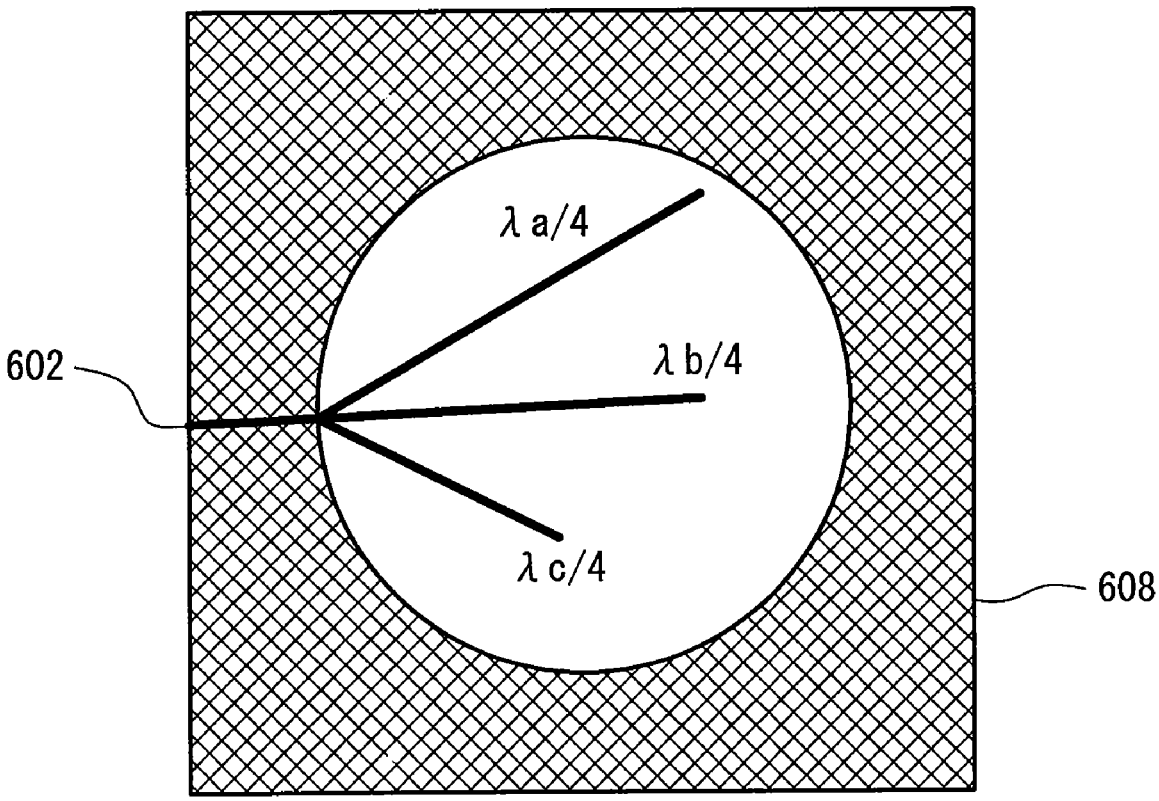
FIG. 9 shows a structure of an antenna pattern formed in an electromagnetic shield body according to a preferred embodiment 6 of the present invention.

FIG. 9 relates to a preferred embodiment 6 of the present invention, and shows a structure of an antenna pattern 602 formed in an electromagnetic shield body 608 formed on the rear surface of the case.

In the antenna pattern 602 according to the present preferred embodiment, the electromagnetic shield body in the periphery of the antenna pattern 602 is removed, and a plurality of antenna patterns 602 each having a wavelength of ¼ of the communication radio wavelength are formed.

Accordingly, the communication radio wave in the radio communication in any arbitrary band can be more reliably grasped.

It is unnecessary to form the plurality of antenna patterns 602 in one antenna wire, and each of the antenna patterns 602 may be formed in each of antenna wires.

Preferred Embodiment 7

Figure 10:
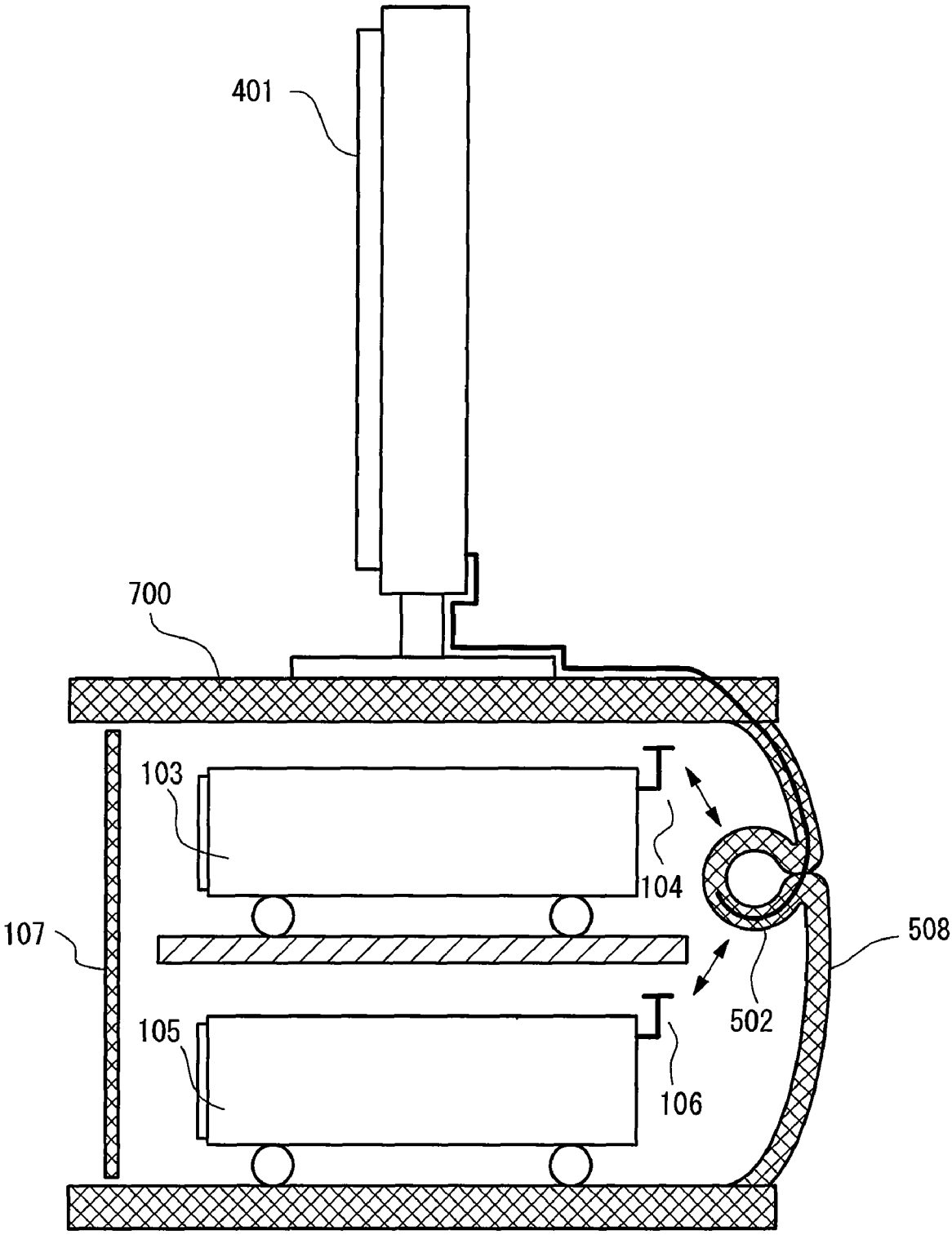
FIG. 10 shows an electronic device containing case and a structure where an electronic device is contained in the case according to a preferred embodiment 7 of the present invention.

FIG. 10 shows an electronic device containing case 700 and a structure where an electronic device is contained in the electronic device containing case 700 according to a preferred embodiment 5 of the present invention.

In FIG. 10, the same components as those shown in FIGS. 1, 4, 5 and 6 are provided with the same reference symbols, and the description of the components is omitted.

In the present preferred embodiment, a ceiling surface, a floor surface, side surfaces and a front door of the electromagnetic device containing case 700 are electromagnetically shielded, which blocks the electromagnetic wave invading into the case 700. In FIG. 7, all of the surfaces of the case 700 (except for the rear surface of the case where the electromagnetic shield body 508 is provided) are electromagnetically shielded; however, at least one of the surfaces is preferably electromagnetically shielded. As a result, the radio communication can be performed while the electromagnetic wave interference is further controlled.

Figure 11:
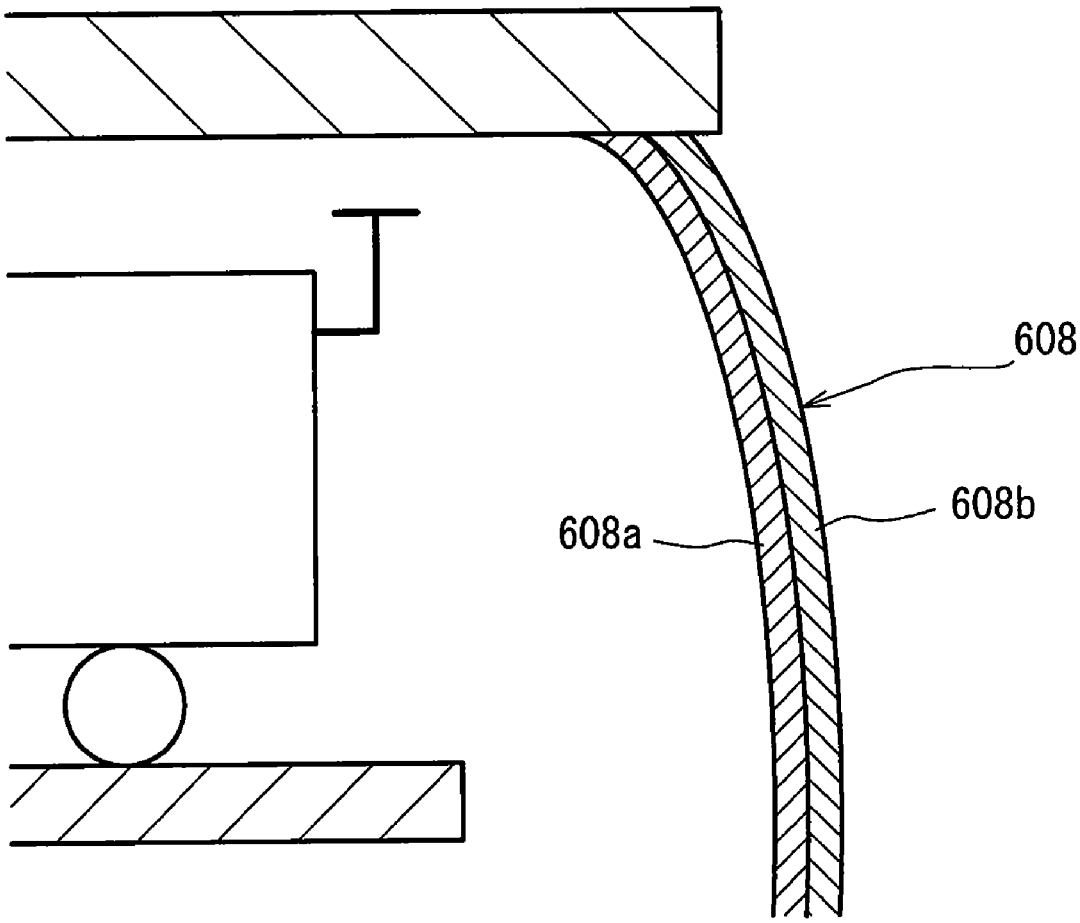
FIG. 11 is an enlarged sectional view of a main part which illustrates a modified embodiment of the electromagnetic shield body according to the preferred embodiments.

In the respective preferred embodiments, the electromagnetic shield body has a single-layer structure comprising an electromagnetic reflector or an electromagnetic absorber. As shown in FIG. 11, however, the electromagnetic shield body may be an electromagnetic shield body 608 having a multilayer structure comprising an electromagnetic reflector 608*a* and an electromagnetic absorber 608*b*. In that case, the electromagnetic shield body 608 may be provided on a wall surface of a case 800 (rear surface or the like) so that the electromagnetic reflector 608*a* is on an inner side of the case and the electromagnetic absorber 608*b* is on an outer side of the case. Accordingly, the electromagnetic wave coming from the inside of the case can be reliably reflected toward the inside, while the electromagnetic wave coming from the outside of the case can be reliably absorbed.

Figure 12A:
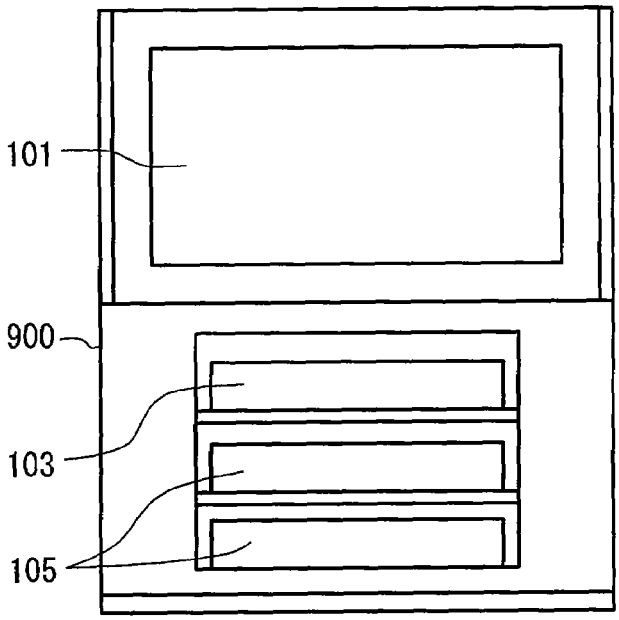
FIG. 12A is a plan view of an electronic device containing case and a structure where an electronic device is contained in the case according to a modified embodiment of the preferred embodiments.
Figure 12B:
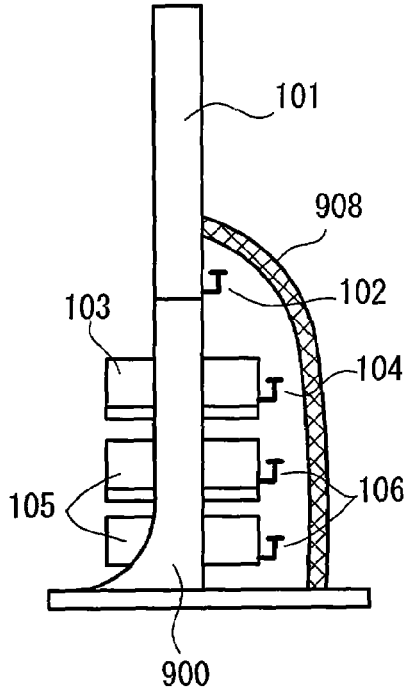
FIG. 12B is a side view of the electronic device containing case and the structure where the electronic device is contained in the case according to the modified embodiment of the preferred embodiments.

In the respective preferred embodiments, the present invention was implemented by using the electronic device case formed in a cubic shape, comprising a front door and formed from wood or resin. However, an electromagnetic shield body 908 may be provided on a wall surface (the rear surface of the case in this example) of an electronic device case 900 not having a front door as shown in FIGS. 12A and 12B.

In the respective preferred embodiments, the electromagnetic shield body is provided on the rear surface of the electronic device containing case. However, the electromagnetic shield body may be provided at any one of the wall surfaces of the case, and the provision of the electromagnetic shield body on the rear surface of the case is merely an example of optimum constitutions.

INDUSTRIAL APPLICABILITY

An electronic device containing case according to the present invention is applicable as an instrument for unfailingly realizing the radio communication in an AV rack for containing AV devices capable of the radio communication and in a PC case for containing a PC module capable of the radio communication.

What is claimed is:

1. An electronic device containing case for containing an electronic device capable of radio communication, wherein an electromagnetic shield body is provided on a wall surface of the case, an antenna pattern for the radio communication which is connected to the electronic device is provided in the electromagnetic shield body, the electromagnetic shield body is a metallic net having a mesh shape, the electromagnetic shield body comprises a narrowed-down portion formed when the electromagnetic shield body is folded and narrowed down into an arbitrary shape, and the antenna pattern is provided in the narrowed-down portion.

2. The electronic device containing case as claimed in claim 1, wherein the narrowed-down portion is provided on a surface of the electromagnetic shield body located on an outer side of the case.

3. The electronic device containing case as claimed in claim 1, wherein the narrowed-down portion is provided on a surface of the electromagnetic shield body located on an inner side of the case.

4. The electronic device containing case as claimed in claim 1, wherein a wiring length of the antenna pattern is ¼ of a communication radio wavelength in the radio communication.

5. The electronic device containing case as claimed in claim 1, wherein at least one of surfaces of the case on which the electromagnetic shield body is not provided is electromagnetically shielded.

6. The electronic device containing case as claimed in claim 1, wherein the electromagnetic shield body has a multilayered structure provided with an electromagnetic reflector and an electromagnetic absorber, and the electromagnetic shield body is provided on the wall surface of the case so that the electromagnetic reflector is on an inner side of the case and the electromagnetic absorber is on an outer side of the case.

7. The electromagnetic shield body as claimed in claim 6, wherein the electromagnetic shield body has a multilayered structure provided with an electromagnetic reflector on an inner side of the case and an electromagnetic absorber on an outer side of the case.

8. An electronic device Structure comprising:

an electronic device comprising an antenna for radio communication; and a case for containing the electronic device, wherein an electromagnetic shield body is provided on a wall surface of the case, the electronic device is contained in the case so that the antenna faces the electromagnetic shield body, an antenna pattern for the radio communication which is connected to the electronic device is provided in the electromagnetic shield body, the electromagnetic shield body is a metallic net having a mesh shape, the electromagnetic shield body comprises a narrowed-down portion formed when the electromagnetic shield body is folded and narrowed down into an arbitrary shape, and the antenna pattern is provided in the narrowed-down portion.

9. The electronic device containing structure as claimed in claim 8, wherein the narrowed-down portion is provided on a surface of the electromagnetic shield body located on an outer side of the case.

10. The electronic device containing structure as claimed in claim 8, wherein the narrowed-down portion is provided on a surface of the electromagnetic shield body located on an inner side of the case.

* * * * *